US006320309B1

(12) United States Patent
Nomura et al.

(10) Patent No.: US 6,320,309 B1
(45) Date of Patent: Nov. 20, 2001

(54) ANODE SUBSTRATE FOR DISPLAY DEVICE AND METHOD FOR MANUFACTURING SAME

(75) Inventors: Yuji Nomura; Mamoru Namikawa; Yasuyuki Naito, all of Mobara (JP)

(73) Assignee: Futaba Denki Kogyo Kabushiki Kaisha, Mobara (JP)

( * ) Notice: Subject to any disclaimer, the term of this patent is extended or adjusted under 35 U.S.C. 154(b) by 0 days.

(21) Appl. No.: 09/197,702

(22) Filed: Nov. 23, 1998

(30) Foreign Application Priority Data

Dec. 24, 1997 (JP) ..... 9-355489

(51) Int. Cl.[7] ..... H01J 1/62; H01J 63/14; H01J 9/00; H01J 9/24

(52) U.S. Cl. ..... 313/495; 313/496; 313/497; 445/23; 445/24

(58) Field of Search ..... 313/489, 371, 313/461, 466, 473, 474, 477 R, 479, 582–587, 493, 634, 635, 631–32, 491–92; 501/68–70; 445/23, 24

(56) References Cited

U.S. PATENT DOCUMENTS

| | | | | |
|---|---|---|---|---|
| 4,004,176 | * | 1/1977 | Otake et al. | 313/371 |
| 5,838,106 | * | 11/1998 | Funada | 313/587 |
| 6,034,474 | * | 3/2000 | Ueoka et al. | 313/584 |
| 6,066,917 | * | 5/2000 | Funada | 313/587 |

* cited by examiner

*Primary Examiner*—Nimeshkumar D. Patel
*Assistant Examiner*—Mack Haynes
(74) *Attorney, Agent, or Firm*—Oblon, Spivak, McClelland, Maier & Neustadt, P.C.

(57) ABSTRACT

An anode substrate for a display device which is made of a glass plate and of which an inner surface formed thereon with color filters is smoothed with a smoothing layer. The anode substrate is subject to a heating treatment during manufacturing thereof is provided. The anode substrate includes at least one smoothing layer made of low-melting glass and formed on the inner surface of the glass plate. The low-melting glass has a softening point lower than a distortion point of the glass plate and a distortion point equal to or higher than a heating temperature in the subsequent step. A method for manufacturing the anode substrate is also disclosed.

6 Claims, 6 Drawing Sheets

ANODE SUBSTRATE FOR DISPLAY DEVICE AND METHOD FOR MANUFACTURING SAME

BACKGROUND OF THE INVENTION

This invention relates to an anode substrate for a display device which includes a glass plate provided on an inner surface thereof with color filters and a method for manufacturing the same, and more particularly to a color filter-equipped anode substrate for a display device such as, for example, a fluorescent display device, a field emission display (FED) utilizing field emission cathodes (FECs) as an electron source, a plasma display (PDP) or the like and a method for manufacturing the same.

There has been known in the art a color fluorescent display device including a combination of a phosphor ZnO:Zn emitting light of a bluish green luminous color and color filters. Manufacturing of the color fluorescent display device includes a heat treatment step carried out at a temperature of 500° C., thus, a material for the color filters is required to be heat resistant. For example, color filters made of an organic material and used for an LCD or the like fail to be used for the color fluorescent display device. Thus, it is required to make the color filters of an inorganic material. Inorganic materials conventionally used for this purpose include a metal colloid, an inorganic pigment and the like.

Now, arrangement of color filters in an FED will be described with reference to FIG. 6. First of all, an anode substrate 100 made of a light-permeable material such as glass or the like is formed thereon with color filters 101, 102 and 103, on which a smoothing layer 104 is commonly arranged. Then, transparent conductive films 105 made of indium tin oxide (ITO) or the like are arranged on the smoothing layer 104. The smoothing layer 104 may be constituted of a $SiO_2$ film or the like made by sputtering, vapor deposition, CVD, sol-gel techniques or the like. Then, a phosphor is deposited on each of the transparent conductive films 105, to thereby form a phosphor layer, resulting in the anode substrate 100 being finished. Then, a cathode substrate on which FECs are formed is arranged in such a manner that the FECs face the phosphors of the anode substrate 100 while being spaced at a microdistance from the phosphors. Finally, both substrates are sealedly joined to each other by means of a spacer member arranged in a gap defined therebetween while being positioned at an outer periphery of the substrates, to thereby provide an envelope, which is then evacuated to a high vacuum.

In operation of the thus-formed FED, electrons emitted from the FECs are impinged on the phosphor layers of the anode substrate 100, leading to luminescence of the phosphor layers. Luminescence of the phosphor layers is observed through the transparent conductive films 105, color filters 101, 102 and 103, and anode substrate 100 from an outside of the anode substrate 100. The ZnO:Zn phosphor has a wide spectrum. Thus, when the color filters 101, 102 and 103 are colored red (R), green (G) and blue (B) and the phosphor layers are selectively driven so as to emit light in a dot-like manner, the FED is permitted to carry out full-color graphic display.

A color filter made of an inorganic material is disclosed in Japanese Patent Application Laid-Open Publication No. 310061/1994 and Japanese Patent Application Laid-Open Publication No. 73827/1995. Unlike an organic color filter, the inorganic color filter is reduced in tinting strength. Thus, in order to ensure that the inorganic color filter satisfactorily exhibits a color reproduction range, it is required that the color filter is formed into an increased thickness as large as several microns to tens of microns. Unfortunately, such an increase in thickness of the color filter causes a difference in level to occur between the color filter and the anode substrate. This requires to laminatedly arrange the smoothing layer on the color filters to smooth an upper surface of the color filters as described above. However, there has been found no inorganic material which permits the smoothing layer increased in thickness in conformity to the color filters to be provided at a reduced cost. Thus, formation of the smoothing layer sufficiently increased in thickness in conformity to a thickness of the color filters so as to prevent formation of the difference in level causes the smoothing layer 104 to be readily broken or cracked. In view of such a problem, it would be considered that the transparent conductive films 105 each are formed directly on each of the color filters 101, 102 and 103 as shown in FIG. 7. Unfortunately, this causes disconnection of the transparent conductive film 105 at a level difference between each of the color filters 101, 102 and 103 and the anode substrate 100. Also, such formation of the smoothing layer 104 on the color filters using $SiO_2$ or the like as described above with reference to FIG. 6 actually renders smoothing of the level difference between the color filters 101, 102 and 103 and the anode substrate 100 highly difficult as shown in FIG. 8, so that the level difference leads to disconnection of the transparent conductive film 105 of ITO or the like formed on each of the color filters 101, 102 and 103. Further, this, even when such disconnection of the transparent conductive films 105 does not occur, gives rise to another problem when the phosphor layers are formed on the transparent conductive films 105 by rotary coating in the subsequent step. More particularly, the rotary coating includes a step of rotating the substrate to spread a liquid for forming each of the phosphor layers on the substrate by centrifugal force, leading to formation of a film of the phosphor forming liquid. However, this substantially fails to permit the phosphor forming liquid which run onto the level difference on the substrate by centrifugal force to be uniformly coated all over each of the transparent conductive films 105, to thereby render the coating non-uniform.

SUMMARY OF THE INVENTION

The present invention has been made in view of the foregoing disadvantage of the prior art.

Accordingly, it is an object of the present invention to provide an anode substrate for a display device which is made of a glass plate and of which an inner surface formed thereon with color filters is smoothed with a smoothing layer.

It is another object of the present invention to provide a method for manufacturing an anode substrate for a display device which is made of a glass plate and of which an inner surface formed thereon with color filters is smoothed with a smoothing layer.

In accordance with one aspect of the present invention, an anode substrate for a display device which is constituted by a glass plate formed on an inner surface thereof with color filters and is subject to a heating treatment during manufacturing thereof is provided. The anode substrate includes at least one smoothing layer made of low-melting glass and formed on the inner surface of the glass plate. The low-melting glass has a softening point lower than a distortion point of the glass plate and a distortion point equal to or higher than a heating temperature in the subsequent step.

In a preferred embodiment of the present invention, the glass plate is made of borosilicate glass.

In a preferred embodiment of the present invention, the color filters each are made of an inorganic pigment.

In a preferred embodiment of the present invention, the low-melting glass is ZnO glass free of Pb.

In a preferred embodiment of the present invention, the ZnO glass free of Pb is selected from the group consisting of low-melting $ZnO—B_2O_3—SiO_2$ glass and low-melting $Bi_2O_3—ZnO—SiO_2$ glass.

In a preferred embodiment of the present invention, the anode substrate further includes an acid-resistant protective film formed on the smoothing layer.

In a preferred embodiment of the present invention, the anode substrate further includes a conductive film formed on the acid-resistant protective film by etching.

In accordance with another aspect of the present invention, a method for manufacturing an anode substrate for a display device which is subject to a heating step during manufacturing thereof is provided. The method includes the steps of forming color filters on an inner surface of a glass plate and forming low-melting glass into at least one smoothing layer on the inner surface of the glass plate. The low-melting glass has a softening point lower than a distortion point of the glass plate and a distortion point equal to or higher than a heating temperature in the subsequent step. The method further includes the step of forming a conductive film on the smoothing layer.

In a preferred embodiment of the present invention, the glass plate is made of borosilicate glass, wherein the low-melting glass is ZnO glass free of Pb.

In a preferred embodiment of the present invention, the method further includes the steps of forming an acid-resistant protective film on the smoothing film after formation of the smoothing layer and forming the conductive film on the acid-resistant protective film by etching.

In a preferred embodiment of the present invention, the smoothing layer is formed of the ZnO glass free of Pb by the steps of depositing the ZnO glass free of Pb on the borosilicate glass plate so as to cover the color filters, subjecting the borosilicate glass plate to calcination at a degassing temperature near a softening temperature of the ZnO glass free of Pb in a vacuum atmosphere, and subjecting the borosilicate glass plate at a temperature higher than the degassing temperature in an air atmosphere.

In a preferred embodiment of the present invention, the method further includes the steps of forming a black matrix for defining a periphery of the color filters on the smoothing layer after formation of the smoothing layer, forming an additional smoothing layer on the smoothing layer so as to cover the black matrix, and forming the conductive film on the additional smoothing layer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
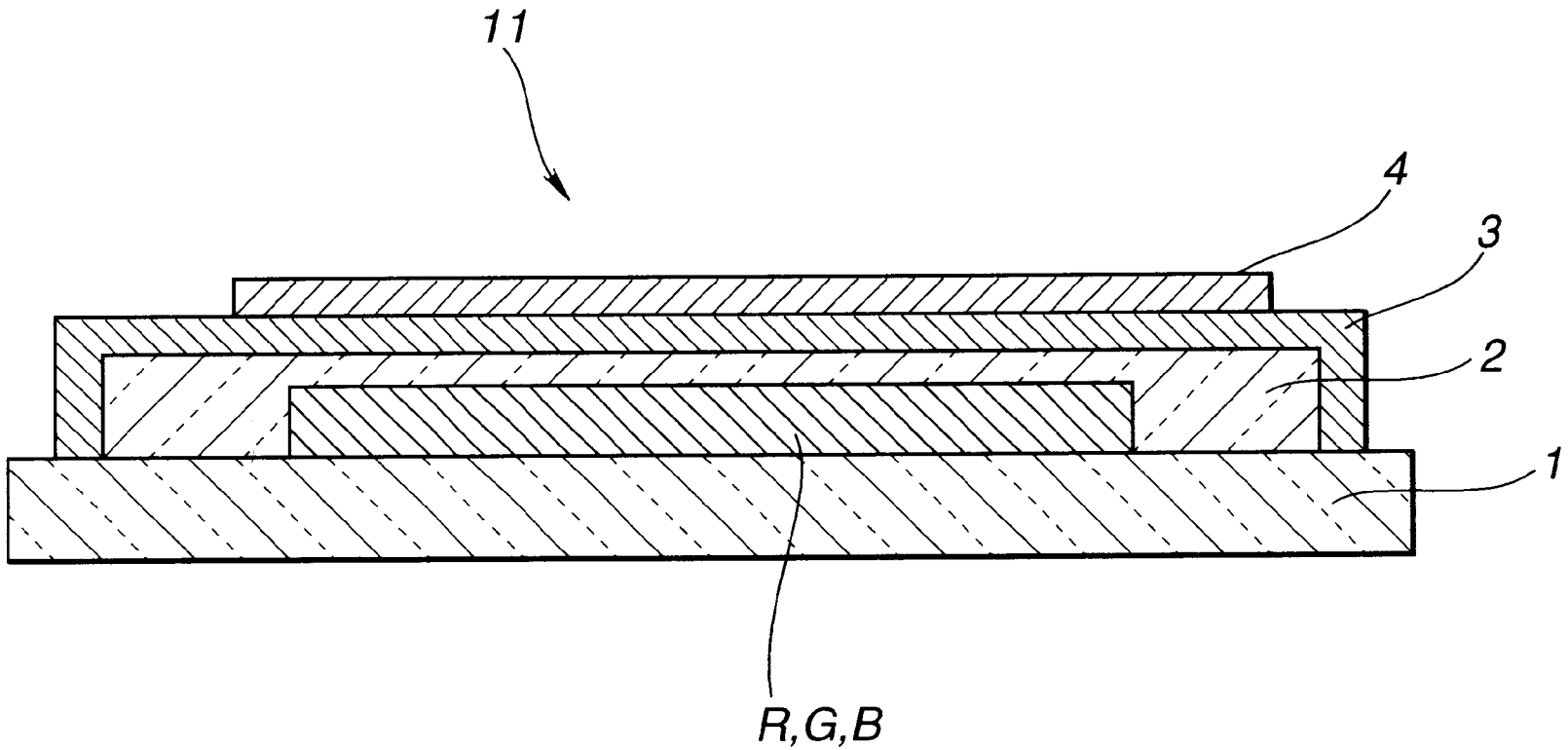
FIG. 1 is a sectional view generally showing a first embodiment of an anode substrate for a display device according to the present invention.

Now, the present invention will be described hereinafter with reference to FIGS. 1 to 5L.

Referring first to FIGS. 1 to 4, a first embodiment of an anode substrate for a display device is illustrated. An anode substrate of the illustrated embodiment for a display device which is generally designated at reference numeral 11 in FIG. 1 include a glass plate 1 made of borosilicate glass. The glass plate 1 is formed thereon with red, green and blue color filters R, G and B of the inorganic pigment-type, on which a smoothing layer 2 is formed, resulting in the glass plate 1 being flattened. The smoothing layer 2 is made of $ZnO—B_2O_3—SiO_2$ glass of a low melting point having a coefficient of thermal expansion relatively similar to that (45 to 50×10−7/° C.) of the borosilicate glass plate 1. Glass materials for the glass plate 1 which are commercially available include that manufactured under a tradename F-54A by NEG and the like. Low-melting $ZnO—B_2O_3—SiO_2$ glass is reduced in acid resistance to a degree sufficient to be corroded by an etchant used in patterning of ITO for an anode electrode of an FED by etching. Thus, $SiO_2$ acting as an acid-resistant protective film 3 is laminatedly arranged on the smoothing layer 2 and then a transparent conductive film 4 is formed on the acid-resistant protective film 3. Such construction of the illustrated embodiment permits the anode substrate 11 including the color filters R, G and B to be manufactured at a reduced cost. Borosilicate glass is used for the glass plate 1 for the reason that it exhibits increased dielectric properties or strength and is significantly reduced in thermal shrinkage and warpage during a heat treatment carried out at 500 to 800° C.

Now, manufacturing and construction of the anode substrate 11 will be described.

Figure 2A:
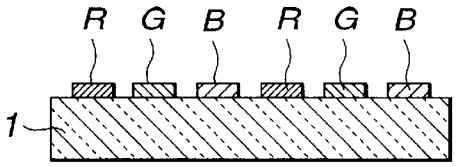
FIGS. 2A to 2J each are a schematic sectional view showing each of steps in manufacturing of the anode substrate of FIG. 1.

First, the borosilicate glass plate 1, as shown in FIG. 2A, is formed thereon with the red, green and blue color filters R, G and B using inorganic pigment materials by any suitable techniques such as, for example, screen printing, etching, photolithography, embedding or the like. For example, the color filters R, G and B may be made of such color filter pastes as disclosed in Japanese Patent Application Laid-Open Publication No. 55064/1996.

Figure 2B:
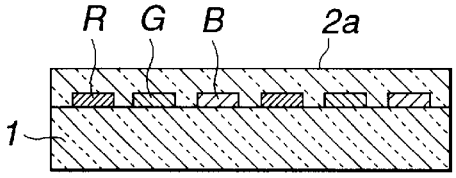

Then, as shown in FIG. 2B, the low-melting $ZnO—B_2O_3—SiO_2$ glass is pasted and then applied or coated onto the borosilicate glass plate 1 by screen printing or the like, to thereby form a layer 2*a* thereon. The application or coating is carried out to a degree sufficient to fully cover regions of the glass plate 1 on which the color filters R, G and B are formed. Thus, it is not necessarily required to cover the remaining region of the glass plate 1 on which wiring conductors and the like are formed. Also, the layer 2*a* is formed into a thickness of 10 to 20 $\mu$m (after calcination) which attains flattening of the color filters R, G and B and permits the layer 2*a* to exhibit sufficient dielectric strength and light permeability or transmission. The layer 2*a* is preferably formed into a thickness which permits it to exhibit visible light transmittance of 90% or more.

Figure 2C:
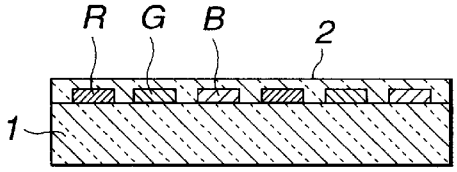

Then, the low-melting layer 2*a* is subject to drying and calcination as shown in FIG. 2C. Calcination of the low-melting layer 2*a* leads to shrinkage of the layer, to thereby provide the smoothing layer 2. The drying may be carried out at 100° C. by means of a hot plate and the calcination may be carried out 600° C. by firing.

Figure 2D:
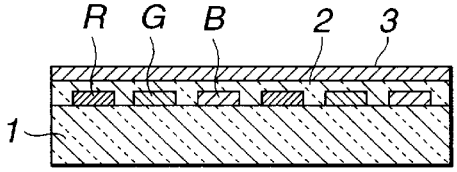

Subsequently, as shown in FIG. 2D, the acid-resistant protective film 3 increased in light permeability and dielectric strength is formed on the smoothing layer 2 by any suitable techniques such as, for example, sputtering, vapor deposition, CVD techniques, sol-gel techniques or the like. The protective film 3 may be made of $SiO_2$. The protective layer 3 may be formed into a thickness of 1000 Å which ensures increased acid resistance and light permeability. Such a thickness of the protective layer 3 permits visible light transmission of the protective film 3 to be increased to a level of 90% or more.

Figure 2E:
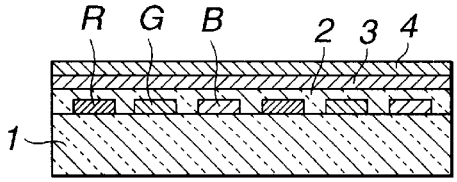

Then, as shown in FIG. 2E, the transparent conductive film 4 acting as an anode electrode is formed of indium tin oxide (ITO) or the like into a thickness of 1500 Å by sputtering.

Figure 2F:
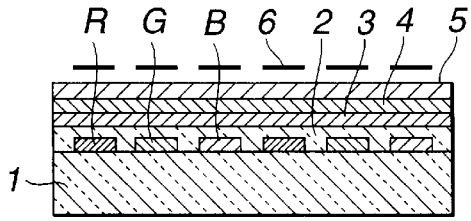

Thereafter, a photoresist 5, as shown in FIG. 2F, is coated on the transparent conductive film 4 for patterning of the transparent conductive film 4 and then subject to pre-baking by means of a hot plate or the like. The photoresist 5 may have a viscosity of 15 cP. Then, the photoresist 5 is exposed to light through a photomask 6 at a rate of 80 to 500 mJ/cm2 by ultraviolet rays. This results in a portion of the photoresist 5 other than a portion thereof formed on the transparent conductive film 4 being subject to exposure.

Figure 2G:
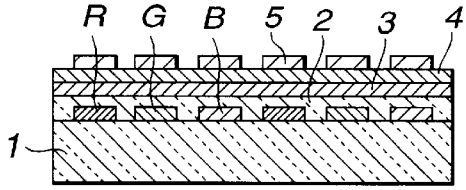

Then, the photoresist 5 is immersed in a developing liquid, resulting in the portion of the photoresist 5 exposed to the light being removed, as shown in FIG. 2G. Further, the photoresist 5 is rinsed with pure water and then subject to post-baking by means of a hot plate or the like.

Figure 2H:
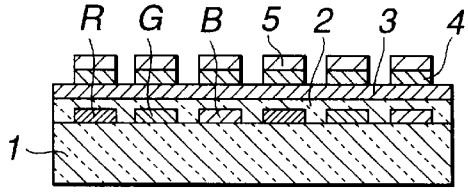

Subsequently, as shown in FIG. 2H, the glass plate 1 is immersed in an etching liquid, so that a portion of the transparent conductive film 4 other than a portion thereof covered with the photoresist 5 may be removed by corrosion. Mixed acid commercially available from TOKYO OHKA KOGYO CO., LTD. may be used as the etching liquid.

Figure 2I:
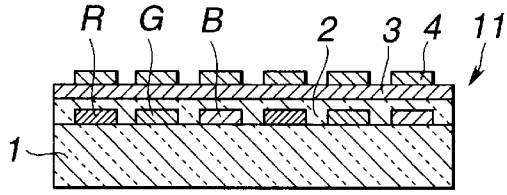

Then, as shown in FIG. 2I, the photoresist 5 is removed by means of a peeling liquid and then the glass plate 1 is rinsed with pure water, followed by cleaning by any optional cleaning step.

Figure 2J:
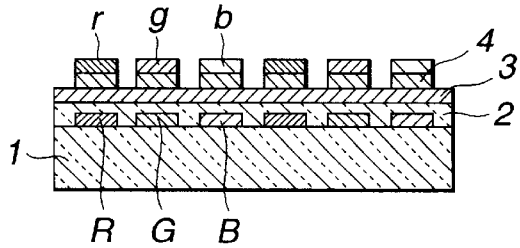

Lastly, phosphors are deposited on desired regions of the transparent conductive film 4 by screen printing, photolithography or the like, as shown in FIG. 2J. In the illustrated embodiment, three kinds of phosphors r, g and b respectively exhibiting red, green and blue luminous colors are arranged in a manner to correspond to the red, green and blue color filters R, G and B, respectively. This results in the anode substrate 11 for an FED which has the color filters R, G and B of the inorganic pigment type formed on the inner surface thereof and includes the smoothing layer 2 made of ZnO glass being provided.

In the illustrated embodiment, a glass material of which the smoothing layer 2 is formed is limited to low-softening or low-melting ZnO glass free of Pb for such reasons as described below. The Zn glass material include ZnO—$B_2O_3$—$SiO_2$, $Bi_2O_3$—ZnO—$SiO_2$ and the like.

The low-melting ZnO glass used in the illustrated embodiment has a softening point of, for example, about 600° C. and a distortion point of, for example, about 500° C., resulting in a temperature difference therebetween being at a level as small as 100° C. On the contrary, glass containing Pb causes such a temperature difference to be increased to a level as large as, for example, 150° C. or more.

In the illustrated embodiment, the calcination step associated with formation of the phosphor layers r, g and b and the subsequent calcination step associated with seal formation and sealing are carried out after formation of the transparent conductive film 4 (ITO wirings) on the smoothing layer 2. A distortion point of the glass of which the smoothing layer 2 is formed must be above the calcination temperature in each of the subsequent steps. In the illustrated embodiment, the distortion point is a temperature of the glass at which a viscosity of the glass is $4\times10^{14}$ P. An increase in temperature of the glass causes viscous flow of the glass. Also, in the illustrated embodiment, the calcination temperature is set at a level of 500° C. or more. The distortion point is set at such a level as described above in order to prevent the transparent conductive film 4 formed of ITO wirings or the like on the glass smoothing film 2 from being disconnected to broken by viscous flow of the smoothing layer 2. The low-melting ZnO glass used in the illustrated embodiment has a distortion point of, for example, about 500° C., which is substantially equal to the calcination temperature in the subsequent step, to thereby eliminate any possible disconnection of the transparent conductive film 4.

Also, a softening point of the glass for the smoothing layer 2 must be substantially low as compared with a distortion point of the glass plate 1. The softening point is a temperature of the smoothing layer 2 at which a viscosity thereof is $4\times10^{7}$ P. A working temperature is above the softening point. In the illustrated embodiment, the borosilicate glass plate 1 has a distortion point of 650° C., whereas the low-melting ZnO glass described above has a softening point of about 600° C. Thus, the illustrated embodiment ensures that the softening point is substantially lower than the distortion point.

Further, the low-melting point ZnO glass used in the illustrated embodiment is electrically stable and does not cause a deterioration in insulating resistance thereof due to driving under a high voltage.

Moreover, the low-melting ZnO glass is chemically stable with respect to the materials for the color filters and a black matrix. On the contrary, PbO reacts with $Fe_2O_3$ (red) contained in the filter material to change it to FeO (black). Thus, it is not suitable for the low-melting glass material.

In addition, use of borosilicate glass for the glass plate 1 is for the reason that borosilicate glass minimizes warpage and shrinkage thereof possibly occurring at calcination at a temperature as high as 600° C. Any possible warpage of the glass plate 1 causes it to be readily broken when it is combined with another substrate to form a panel-like display device. The shrinkage leads to misregistration of anode patterns.

Figure 3:
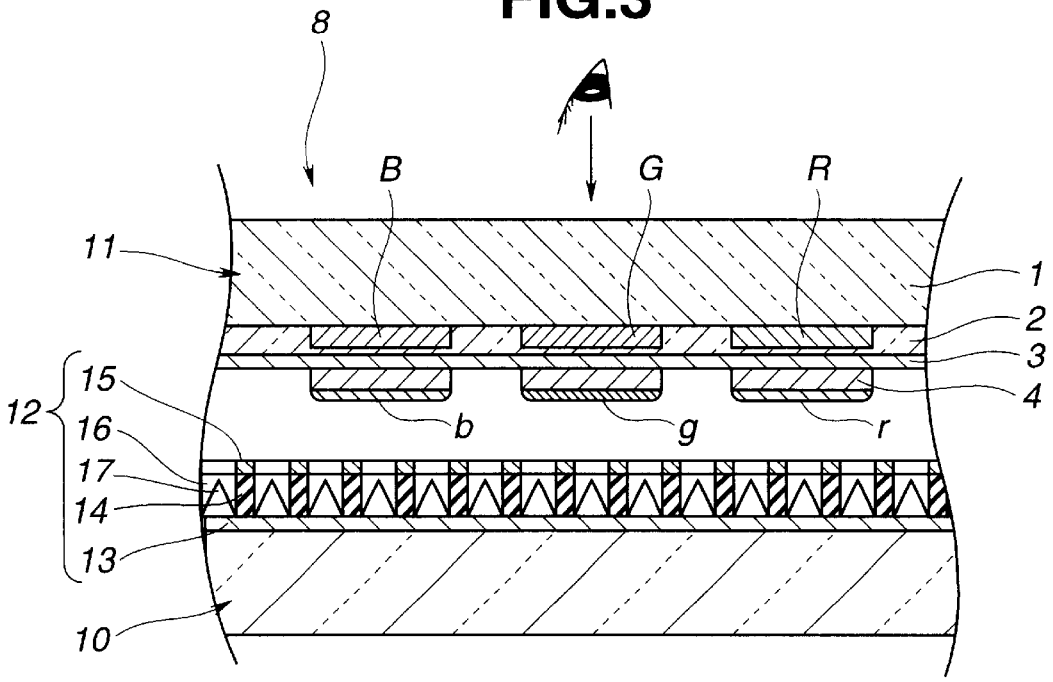
FIG. 3 is a fragmentary sectional view showing an essential part of an FED in which the anode substrate shown in FIG. 1 is incorporated.

Now, an FED constructed using the above-described anode substrate 11 will be described with reference to FIG. 3, wherein the FED is generally designated at reference numeral 8.

First, phosphor layers r, g and b are formed on the transparent conductive film 4 on the anode substrate 11. In FIG. 3, three kinds of phosphors r, g and b respectively exhibiting red, green and blue luminous colors are arranged in a manner to correspond to the red, green and blue color filters R, G and B, respectively. Alternatively, a ZnO:Zn phosphor which emits light increased in spectral band width including luminous color ingredients of red, green and blue may be used commonly to the color filters R, G and B. The FED also includes an anode substrate 10 arranged so as to face the phosphors r, g and b of the anode substrate 11. The cathode substrate 10 is formed on an inner surface thereof with FECs 12 in a manner to face the phosphor layers r, g and b. The FECs 12 each include a cathode conductor formed on the inner surface of the cathode substrate 10, an insulating layer 14 formed on the cathode conductor 13, a gate electrode 15 formed on the insulating layer 14, holes 16 formed in the gate electrode 15 and insulating layer 14 so as to commonly extend therethrough, and emitters 17 arranged in the holes 16 while being positioned on the cathode conductor 13 and exposed at a tip end thereof through the holes 17. The cathode substrate 10 is arranged opposite to the anode substrate 11 in such a manner that the FECs 12 of the cathode substrate 10 face the phosphor layers r, g and b of the anode substrate 11 so as to be spaced at a microdistance therefrom. Both substrates 10 and 11 are sealedly joined to each other through a spacer member arranged therebetween so as to be positioned at an outer periphery of the substrates 10 and 11, resulting in providing an envelope, which is then evacuated to a high vacuum.

In operation of the FED thus constructed, electrons emitted from the FECs 12 are impinged on the phosphor layers r, g and b of the anode substrate 11 to excite the phosphor layers, leading to luminescence of the phosphor layers. The thus-obtained luminescence is observed as red, green and blue through the transparent conductive film 4, color filters R, G and B, and glass substrate 1 from an outside of the anode substrate 11. When the FED is constructed so as to permit the phosphor layers r, g and b to selectively emit light in a dot-like manner, it may carry out full-color graphic display.

Figure 4:
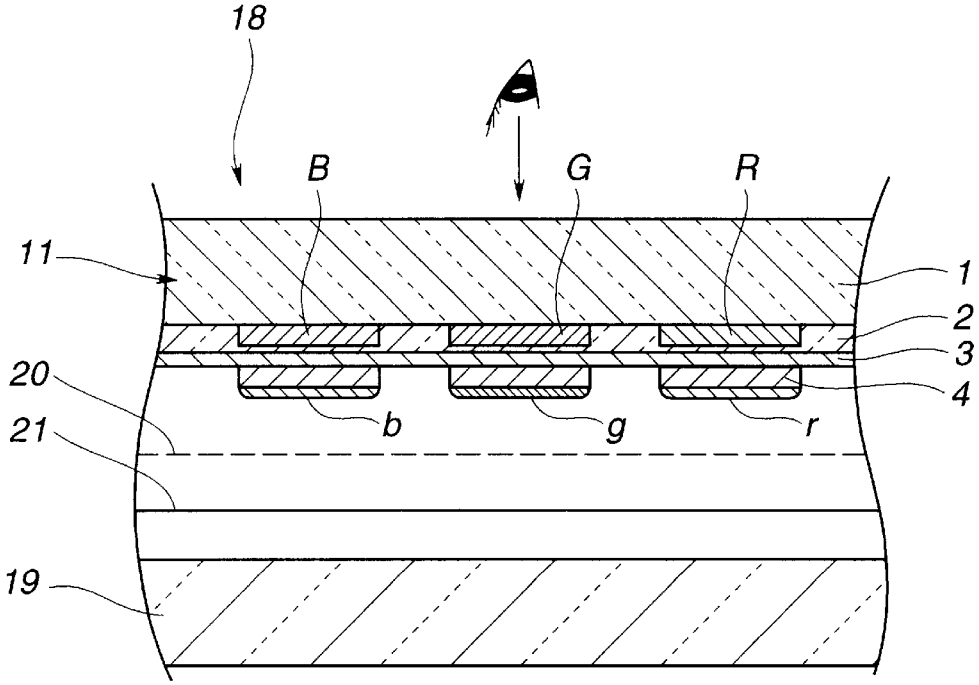
FIG. 4 is a fragmentary sectional view showing an essential part of a fluorescent display device in which the anode substrate shown in FIG. 1 is incorporated.

Now, a fluorescent display device constructed using the above-described anode substrate 11 will be described with reference to FIG. 4, wherein the fluorescent display device is generally designated at reference numeral 18.

First, the transparent conductive film 4 of the anode substrate 11 is formed thereon with phosphor layers r, g and b. In FIG. 4, three kinds of phosphors r, g and b exhibiting red, green and blue luminous colors are arranged in a manner to correspond to the red, green and blue color filters R, G and B, respectively. Alternatively, a ZnO:Zn phosphor which emits light increased in spectral band width including luminous color ingredients of red, green and blue may be used commonly to the color filters R, G and B. The fluorescent display device 18 also includes a rear substrate 19 arranged opposite to the anode substrate 11 in a manner to face the phosphors r, g and b of the anode substrate 11 while being spaced therefrom at a predetermined interval. Between the abode substrate 11 and the rear substrate 19 is arranged a side plate (not shown) so as to be positioned at an outer periphery of both substrates. The anode substrate 11, rear substrate 19 and side plate thus arranged cooperate to each other to provide a box-like envelope. The envelope thus constructed is provided therein with a control electrode in a manner to be positioned below the phosphor layers r, g and b. Also, the envelope has filamentary cathodes 21 stretchedly arranged therein, which are positioned below the control electrode 20. The envelope is evacuated to a high vacuum.

In operation of the fluorescent display device 18 thus constructed, electrons emitted from the filamentary cathodes 21 are accelerated by the control electrode 20 while being controlled thereby, to thereby be impinged on the phosphor layers r, g and b of the anode substrate 11, leading to luminescence of the phosphor layers. Luminescence of the phosphor layers r, g and b is observed as each of red, green and blue through the transparent conductive film 4, color filters R, G and B, and anode substrate 11 from an outside of the anode substrate 11. When the fluorescent display device is constructed so as to permit the phosphor layers r, g and b to selectively emit light in a dot-like manner, it may carry out full-color graphic display.

Use of the anode substrate 11 manufactured by the illustrated embodiment as an anode substrate for a display device permits contrast in display obtained to be enhanced as compared with the conventional anode substrate including the color filters R, G and B.

Now, a second embodiment of the present invention will be described hereinafter.

In the second embodiment, a smoothing layer 2 is subject to calcination in a vacuum atmosphere, to thereby outwardly discharge gas contained in the smoothing layer 2 therefrom or degas the smoothing layer 2, resulting in transmittance of the smoothing layer 2 and surface flatness thereof being increased. The smoothing layer 2 is likewise made of a low-melting ZnO glass material such as, for example, $ZnO—B_2O_3—SiO_2$. The remaining part of the second embodiment may be constructed in substantially the same manner as the first embodiment described above.

Now, steps including the degassing treatment in manufacturing of an anode substrate of the second embodiment will be described hereinafter.

First, the same steps as those shown in FIGS. 2A and 2B are carried out. Then, a glass plate is dried at 100° C. by means of a hot plate or the like, subject to calcination at a temperature of 550° C. in an air atmosphere, subject to calcination at 550 to 600° C. in a vacuum atmosphere or a degassing treatment, and then subject to a calcination at 600 to 640° C. in an air atmosphere.

The remaining steps are substantially the same as shown in FIGS. 2D to 2J.

In general, when a glass powder is melted, resulting in being fluidized, air bubbles contained in the glass are discharged. The low-melting ZnO glass used in the illustrated embodiment is crystallized at about 650° C. before full fluidization thereof, resulting in failing to permit air bubbles to be fully discharged therefrom. However, the degassing treatment described above leads to heating of the low-melting glass to a temperature which permits it to start to be melted in a vacuum atmosphere, so that air in voids between particles of the glass may be outwardly discharged. Then, the atmosphere is returned to an air atmosphere, so that the atmospheric pressure crushes the voids between the particles, to thereby reduce the amount of air bubbles remaining in the glass. This leads to an increase in both transparency of the smoothing layer 2 made of glass and flatness of a surface thereof.

Now, a third embodiment of an anode substrate according to the present invention will be described hereinafter with reference to FIGS. 5A to 5L.

The third embodiment is featured in that a smoothing layer forming step is carried out twice, to thereby form a black matrix (BM) between smoothing layers thus formed. This permits color filters and the black matrix to be separated from each other. The smoothing layers each are formed of a low-melting ZnO glass material such as, for example, $ZnO—B_2O_3—SiO_2$ or the like.

Arrangement of the color filters and black matrix on a glass plate in juxtaposition to each other causes an increase in contact area between the color filers and black matrix and the smoothing layers, to thereby correspondingly increase stress accumulated in the smoothing layers. This would occasionally lead to cracking of the smoothing layers. Separation of the color filters and black matrix from each other in the illustrated embodiment results in stress accumulated in the smoothing layers being diffused or dispersed, to thereby prevent cracking of the smoothing layers.

Now, manufacturing and construction of the anode substrate of the third embodiment will be described with reference to FIGS. 5A to 5L.

Figure 5A:
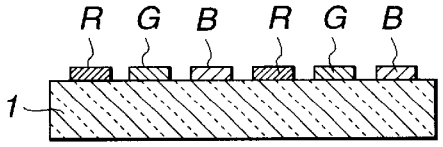
FIGS. 5A to 5L each are a schematic sectional view showing each of steps in manufacturing of a third embodiment of an anode substrate according to the present invention.

First, the glass plate 1 made of borosilicate glass, as shown in FIG. 5A, is formed thereon with red, green and blue color filters R, G and B using inorganic pigment materials by any suitable techniques such as, for example, screen printing, etching, photolithography, embedding or the like. Borosilicate glass manufactured under a tradename "OA-2" by NEG may be used for the glass plate 1. The color filters R, G and B may be made of, for example, such color filter pastes as disclosed in Japanese Patent Application Laid-Open Publication No. 55064/1996.

Figure 5B:
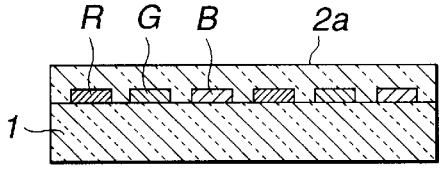

Then, as shown in FIG. 5B, the low-melting $ZnO—B_2O_3—SiO_2$ glass is applied or coated onto the borosilicate glass plate 1 by screen printing, to thereby form a layer 2*a* thereon. Low-melting $ZnO—B_2O_3—SiO_2$ glass manufactured under a tradename "F-54A" by NEG may be used for this purpose. The application or coating is carried out to a degree sufficient to fully cover regions of the glass plate 1 on which the color filters R, G and B are arranged. Thus, it is not necessarily required to cover the remaining region of the glass plate 1 on which wiring conductors and the like are formed. Also, the layer 2*a* is formed into a thickness of 10 to 20 $\mu$m (thickness after calcination) which attains flattening of the color filters R, G and B and permits the layer to exhibit sufficient dielectric strength and light permeability or transmittance. The layer 2*a* is preferably formed into a thickness which permits it to exhibit visible light transmittance of 90% or more.

Figure 5C:
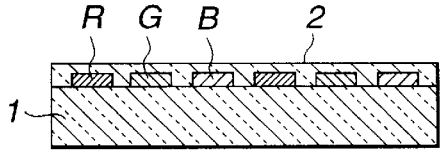

Then, the low-melting layer 2*a* is subject to drying and calcination as shown in FIG. 5C. Calcination of the low-melting layer 2*a* leads to shrinkage of the layer, to thereby provide a smoothing layer 2. The drying may be carried out at 100° C. by means of a hot plate and the calcination may be carried out 600° C. by firing in an air atmosphere.

Figure 5D:
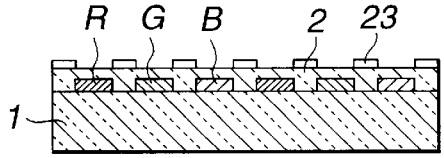

Subsequently, as shown in FIG. 5D, a black matrix 23 is formed on the smoothing layer 2 by screen printing, etching, photolithography, embedding or the like. This may be carried out using, for example, a black matrix paste disclosed in Japanese Patent Application Laid-Open Publication No. 65066/1996.

Figure 5E:
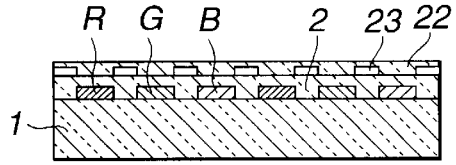

Then, the steps described above with reference to FIGS. 5B and 5C are substantially repeated to form a further smoothing layer 22 on the black matrix 23, as shown in FIG. 5E.

Figure 5F:
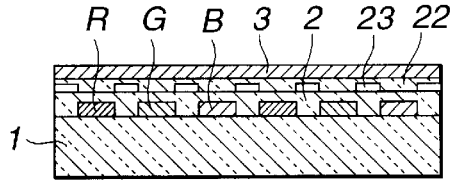

Thereafter, an acid-resistant protective film 3 increased in light permeability and dielectric strength is formed on the smoothing layer 22, as shown in FIG. 5F. This may be carried out by any suitable techniques such as, for example, sputtering, vapor deposition, CVD techniques, sol-gel techniques or the like. The protective film 3 may be formed of $SiO_2$. The protective layer 3 may be formed into a thickness of 1000 Å which ensures an increase in both acid resistance and light permeability of the protective layer 3. Such a thickness permits visible light transmittance of the protective film 3 to be increased to a level of 90% or more.

Figure 5G:
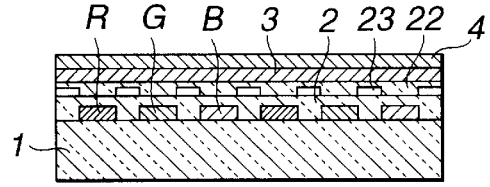

Then, as shown in FIG. 5G, a transparent conductive film 4 acting as an anode electrode is deposited on the protective film 3. The transparent conductive film 4 may be formed of indium tin oxide (ITO) or the like into a thickness of 1500 Å by sputtering.

Figure 5H:
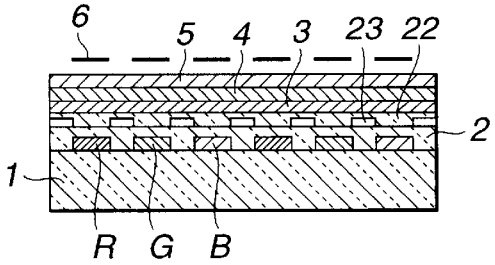

Subsequently, a photoresist 5, as shown in FIG. 5H, is coated on the transparent conductive film 4 for patterning of the transparent conductive film 4 and then subject to pre-baking by means of a hot plate or the like. The photoresist 5 may have a viscosity of 15 cP. Then, the photoresist 5 is exposed to ultraviolet rays through a photomask 6 at a rate of 80 to 500 mJ/cm$^2$. This results in a portion of the photoresist 5 other than a portion thereof formed on the transparent conductive film 4 being subject to exposure. A material manufactured under a tradename "TSMR-8900" by TOKYO OHKA KOGYO CO., LTD. may be used for formation of the photoresist 5.

Figure 5I:
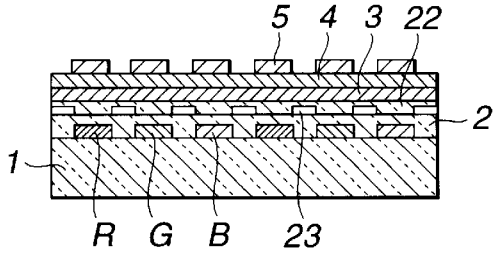

Then, the photoresist 5 is immersed in a developing liquid, which may be commercially available under a tradename "NMD-W" from TOKYO OHKA KOGYO CO., LTD., resulting in the portion of the photoresist 5 exposed to the light being removed, as shown in FIG. 5I. Then, the glass plate 1 is rinsed with pure water and then subject to post-baking by means of a hot plate or the like. The post-baking may be carried out at 140° C. for 5 minutes.

Figure 5J:
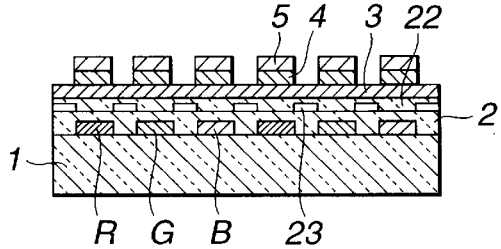

Subsequently, as shown in FIG. 5J, the glass plate 1 is immersed in an etching liquid, so that a portion of the transparent conductive film 4 other than a portion thereof covered with the photoresist 5 may be removed by corrosion. Such etching may be carried out for 6 minutes while keeping the etching liquid at 40° C. Mixed acid commercially available from TOKYO OHKA KOGYO CO., LTD. may be used as the etching liquid.

Figure 5K:
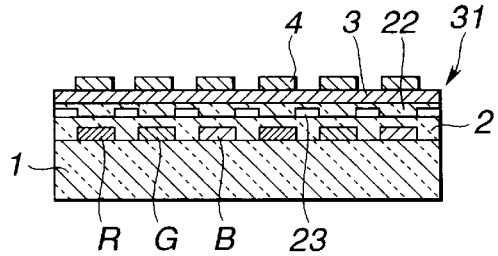

Then, as shown in FIG. 5K, the photoresist 5 is removed by means of a peeling liquid and then the glass plate 1 is rinsed with pure water, followed by cleaning by any optional cleaning step. A liquid commercially available under a tradename "106" from TOKYO OHKA KOGYO CO., LTD.

Figure 5L:
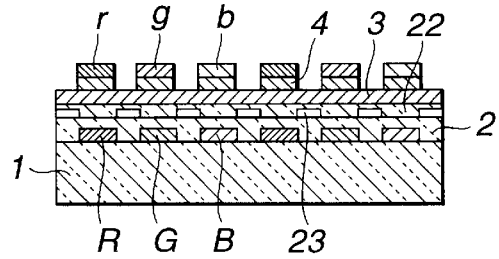
Figure 6:
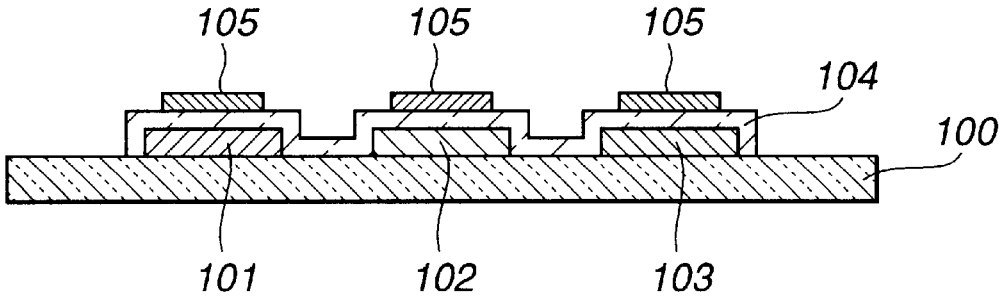
FIG.6 (PRIOR ART)
FIG. 6 is a sectional view showing a conventional anode substrate for a display device which includes color filters used in an FED.
Figure 7:
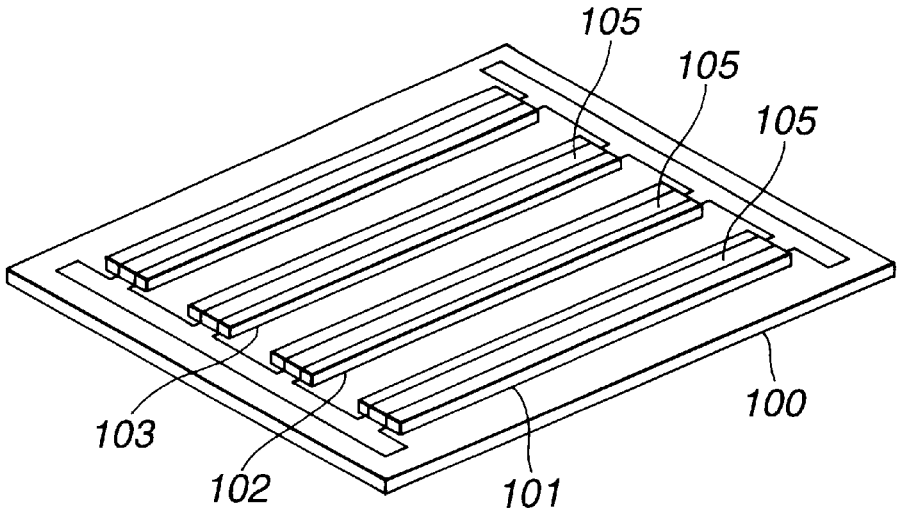
FIG.7 (PRIOR ART)
FIG. 7 is a perspective view showing a conventional anode substrate for a display device which includes color filters used in an FED.
Figure 8:
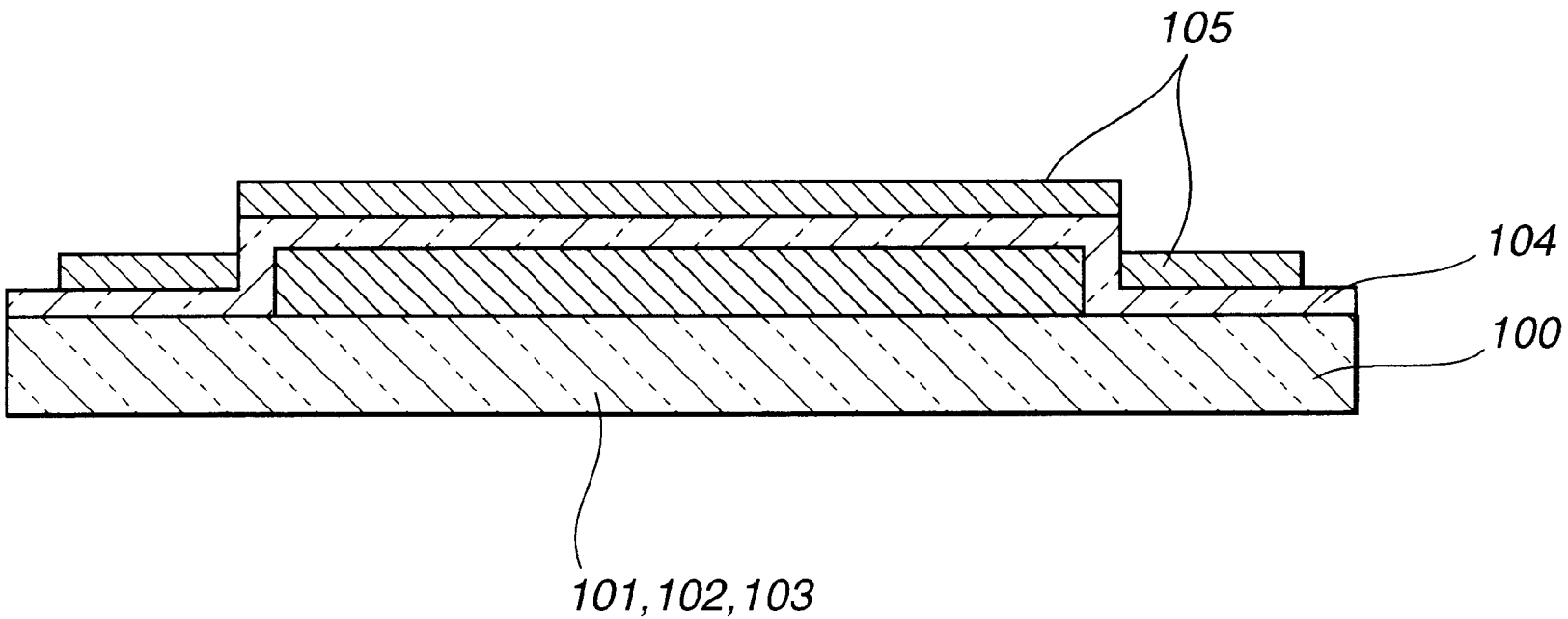
FIG.8 (PRIOR ART)
FIG. 8 is a sectional view showing a conventional anode substrate for a display device including color filters.

Lastly, as shown in FIG. 5L, phosphors are deposited on desired regions of the transparent conductive film 4 by screen printing, photolithography or the like, to thereby form phosphor layers r, g and b. In the illustrated embodiment, the phosphor layers r, g and b respectively exhibiting red, green and blue luminous colors are arranged in a manner to positionally correspond to the red, green and blue color filters R, G and B, respectively. This results in the anode substrate 31 for an FED which has the color filters R, G and B of the inorganic pigment type formed on an inner surface thereof and includes the black matrix 23 being provided.

An FED in which the anode substrate 31 of the illustrated embodiment is incorporated prevents leakage of light reflected on a cathode surface of the FED through any non-luminous section, to thereby improve contrast of an image displayed.

The present invention is not limited to application to such a fluorescent display device and an FED as described above. It may be commonly applied to a display device including such a transparent conductive film as designated at reference numeral 4 herein. For example, it may be applied to a plasma display or a display device including a metal back.

As can be seen form the foregoing, the present invention permits the anode substrate provided with the color filters of the inorganic pigment type to have flatness similar to that of the glass substrate.

Also, the present invention permits low-melting ZnO glass such as $ZnO—B_2O_3—SiO_2$ glass to be formed into a film increased in thickness, to thereby realize an increase in thickness of the color filters. Thus, the present invention ensures that the anode substrate for an FED which includes the color filters of the inorganic pigment type may be manufactured while exhibiting an increased color reproduction range.

Further, the present ensures that the degassing treatment permits low-melting ZnO glass such as $ZnO—B_2O_3—SiO_2$ glass to be provided with light transmittance as high as 93% or more in a visible light region. Thus, the present invention substantially prevents incorporation of the anode substrate of the present invention in a display device from affecting luminous characteristics of the display device.

In addition, low-melting ZnO phosphor such as $ZnO—B_2O_3—SiO_2$ glass or the like exhibits film strength increased to a degree sufficient to fully hold the color filters thereon even during the subsequent violent cleaning or washing step. Thus, the present invention minimizes a failure in display due to any dot detect of the color filter possibly occurring in the step.

Furthermore, covering of the inorganic pigment color filters with low-melting ZnO glass such as $ZnO—B_2O_3—SiO_2$ glass or the like prevents reduction of the pigment in a reducing atmosphere, to thereby prevent a variation in chromaticity of the color filters.

Any ruggedness of the color filters is flattened by the low-melting ZnO glass such as $ZnO—B_2O_3—SiO_2$ glass or the like, to thereby substantially eliminate non-uniformity of the phosphor layers during formation of the phosphors on the transparent conductive film.

Low-melting ZnO glass such as $ZnO—B_2O_3—SiO_2$ glass or the like is inherently increased in resistance. Thus, application of the anode substrate of the present invention to a display device such as an FED or the like permits dielectric strength between anode electrodes of the FED to be highly increased even when the lower layers such as the color filters and the like are reduced in resistance, to thereby ensure satisfactory driving of the FED without any trouble.

Moreover, application of the anode substrate of the present invention to a display device significantly reduces reflection of external light on a surface of the display device, to thereby improve contrast of display obtained.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An anode substrate for a display device which is constituted by a glass plate formed on an inner surface thereof with color filters and is subject to a heating treatment during manufacturing thereof, comprising:

at least one smoothing layer made of low-melting glass and formed on the inner surface of said glass plate;

said low-melting glass having a softening point lower than a distortion point of said glass plate and a distortion point equal to or higher than a heating temperature in a subsequent step;

wherein said low-melting glass is ZnO glass free of Pb.

2. An anode substrate as defined in claim 1, wherein said ZnO glass free of Pb is selected from the group consisting of low-melting $ZnO—B_2O_3—SiO_2$ glass and low-melting $Bi_2O_3—ZnO—SiO_2$ glass.

3. An anode substrate as defined in claim 1, further comprising an acid-resistant protective film formed on said smoothing layer.

4. An anode substrate as defined in claim 3, further comprising a conductive film formed on said acid-resistant protective film by etching.

5. An anode substrate as defined in claim 1, wherein said glass plate is made of borosilicate glass.

6. An anode substrate as defined in claim 1, wherein said color filters each are made of an inorganic pigment.

* * * * *

UNITED STATES PATENT AND TRADEMARK OFFICE

CERTIFICATE OF CORRECTION

PATENT NO. : 6,320,309 B1
DATED : November 20, 2001
INVENTOR(S) : Nomura et al.

It is certified that error appears in the above-identified patent and that said Letters Patent is hereby corrected as shown below:

Title page, Item 54, and Column 1,
The Title of Invention should read:
-- [54] ANODE SUBSTRATE HAVING A SMOOTHING LAYER COMPRISED OF LOW MELTING GLASS --

Item [73], the Assignee's information should read:
-- [73] Assignee: Futaba Denshi Kogyo Kabushiki Kaisha, Mobara (JP) --

Signed and Sealed this

Eleventh Day of June, 2002

*Attest:*

*Attesting Officer*

JAMES E. ROGAN
*Director of the United States Patent and Trademark Office*